United States Patent [19]

Colby

[11] Patent Number: 4,559,878

[45] Date of Patent: Dec. 24, 1985

[54] FOLDABLE TABLE SUITED TO OUTDOOR USE AS WELL AS TO INTERIOR USE

[75] Inventor: Donald B. Colby, Sarasota, Fla.

[73] Assignee: Lee L. Woodard, Inc., Santa Monica, Calif.

[21] Appl. No.: 642,520

[22] Filed: Aug. 20, 1984

[51] Int. Cl.[4] ..... A47B 3/00

[52] U.S. Cl. ..... 108/132; 108/129; 108/160

[58] Field of Search ..... 108/129, 130, 131, 132, 108/133, 160; 16/386

[56] References Cited

U.S. PATENT DOCUMENTS 2,695,827 11/1954 De Saussure, Jr. ..... 108/133
2,695,828 11/1954 Witkowiak ..... 108/132

FOREIGN PATENT DOCUMENTS 355581 8/1961 Switzerland ..... 108/132
1167350 10/1969 United Kingdom ..... 108/132

*Primary Examiner*—James T. McCall
*Attorney, Agent, or Firm*—Learman & McCulloch

[57] ABSTRACT

A folding table, suited to patio and poolside use as well as to interior use and comprising a horizontally disposed table top having a transparent sheet top with a downwardly projecting rim supported by opposed foldable, nesting leg assemblies for said top at opposite ends of said top, movable from a vertical position in which they support said top to a substantially horizontal position folded in nested relation against the bottom side of said top. A spreadable keeper member having a downwardly opening socket is fixed to the underside of said top on each side of the center thereof in a location such as to releasably lockably receive leg brace parts and retain the leg assemblies in vertical position.

5 Claims, 5 Drawing Figures

FOLDABLE TABLE SUITED TO OUTDOOR USE AS WELL AS TO INTERIOR USE

BACKGROUND OF THE INVENTION

This invention relates generally to foldable furniture units, and more specifically to tables which will stably support loads, while still being readily foldable for storage purposes. Tables of the type to which the invention appertains, are normally constructed of lightweight aluminum or other metal parts, and have a transparent, non-shatterable, plastic top which may, or may not, have a central opening to accommodate the pole of an umbrella. It is essential that these units, which are commonly used, for example, on a patio, or at poolside, have a high quality appearance of the type generally associated in the public mind with tables which do not fold. It is also desirable that the leg structure connect with the table top in a manner such that the top does not disengage from the legs, when the table is to be folded and stored.

Prior art patents which have sought to solve the various problems which have been encountered are the following:

U.S. Pat. No. Des. 98,434
U.S. Pat. No. Des. 246,341
U.S. Pat. No. Des. 258,103
U.S. Pat. No. 376,726
U.S. Pat. No. 789,338
U.S. Pat. No. 910,354
U.S. Pat. No. 1,697,550
U.S. Pat. No. 2,131,594
U.S. Pat. No. 2,474,450
U.S. Pat. No. 2,784,042
U.S. Pat. No. 3,026,160
U.S. Pat. No. 4,112,855

One of the prior art patents is my U.S. Pat. No. 4,112,855 which, however, relates to a foldable table in which the top is removably connected to base framework. The present invention is directed to a different type of table in which the legs fold against the underside of the table top in the general manner of a card table, however, the present construction is considerably more sturdy and rigid than the common card table, and presents a far more attractive appearance.

SUMMARY OF THE INVENTION

The folding table of the present invention provides a pair of leg structures supported at each end of the table top by a pair of rotatable shafts. Leg assemblies which mutually internest, when folded in to the table top, are fixed to the shafts, and are rotatable about said shafts, from a position in which the table leg assemblies are perpendicular to the table top and support it in normal fashion, to a folded position in which the legs substantially lie parallel to the table top in internested position.

Keeper members with downwardly opening sockets are provided inboard of the shafts mentioned, and brace members, which may be generally of U-shaped form and pivotally connected to the table legs, have web portions which are received in the sockets, and locked therein. It is when the shafts and brace webs are rotated simultaneously in a compound path of movement that the brace midsections are vertically removable from the sockets, and folding movement is free to take place.

It is an object of the present invention to provide a folding table which, when in use, is extremely rigid and has its brace sections securely locked in position to maintain the table legs in extended position.

It is a further object of the invention to provide a folding table which has ample leg room even in the circular form, and is exremely aesthetic in appearance.

It is another object of the invention to provide a light-weight folding table, which can be relatively economically manufactured, and which can be readily moved about by one individual, either in the folded or erected condition.

Other objects and advantages of the invention will become apparent by reference to the following specification and to the drawings.

IN THE DRAWINGS

Figure 1:
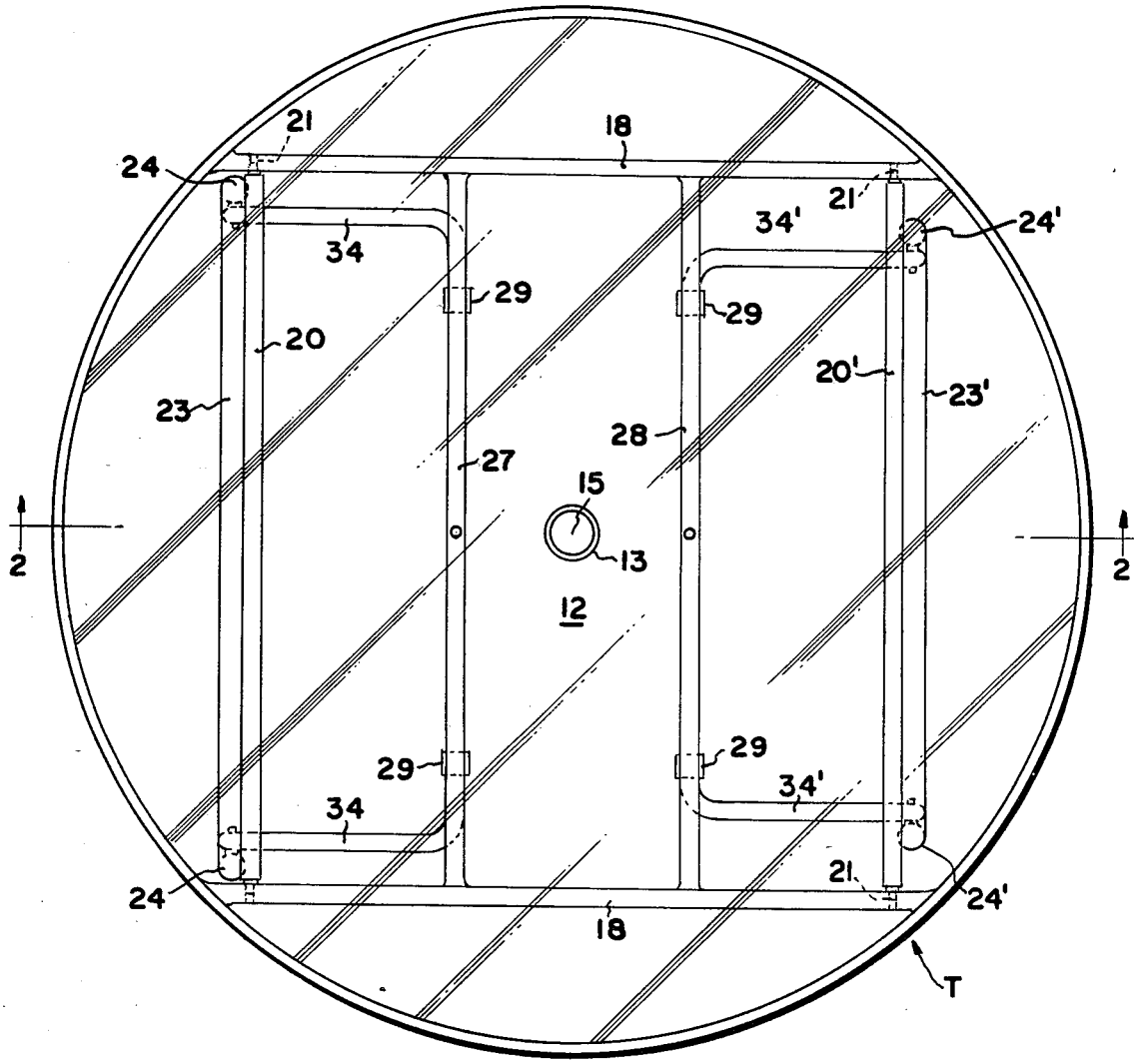
FIG. 1 is a top plan view illustrating a folding table construction in accordance with the invention.
Figure 2:
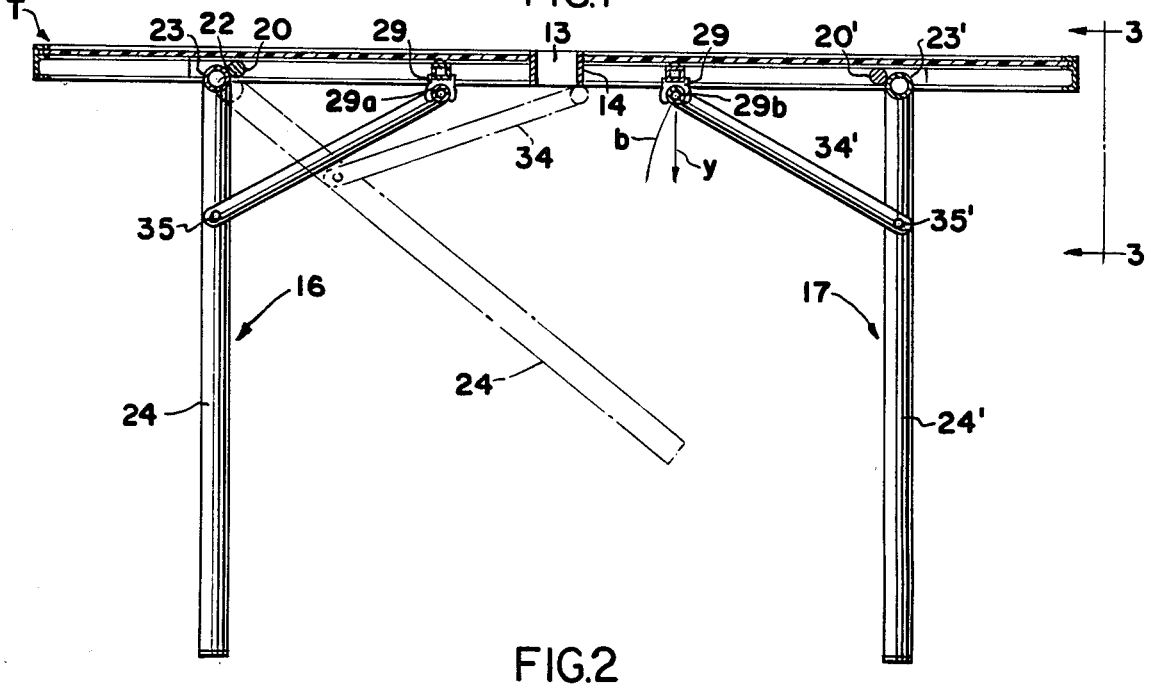
FIG. 2 is a sectional side elevational view thereof taken on the line 2—2 of FIG. 1, with the chain lines illustrating one table leg assembly in a position removed from the keepers and being folded toward the top.
Figure 3:
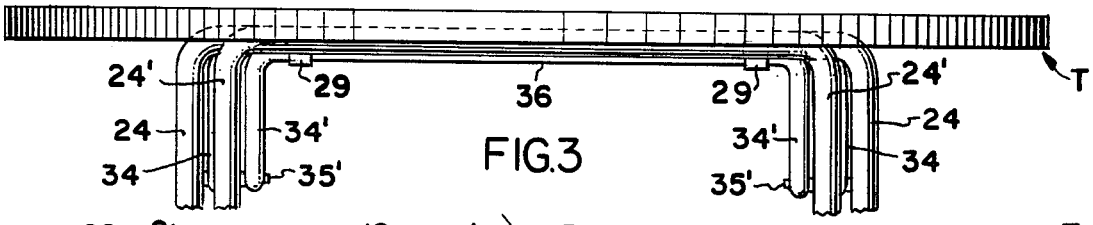
FIG. 3 is an end elevational view, taken on the line 3—3 of FIG. 2.

Referring now more particularly to the accompanying drawings, wherein a preferred embodiment of the invention is disclosed, a letter T generally designates the table top, which consists of a light weight metal rim 10, provided with an inwardly facing upper channel section 11 within which a transparent, preferably non-shatterable, plastic top sheet 12 is received. As shown, the rim 10 and sheet 12 are circular in shape, and the sheet 12 may have an opening 13 within which a liner 14 can be inserted to receive an umbrella pole. As indicated earlier, the table is well suited to patio and outdoor use, and the opening 13 is concentric with the center 15 of the table top.

Provided to support the table top T are a pair of leg assemblies generally designated 16 and 17. Since the leg assemblies 16 and 17 are identical, similar numerals will be used to identify the similar parts thereof, but in the case of leg assembly 17 the numerals will be primed numerals.

Figure 5:
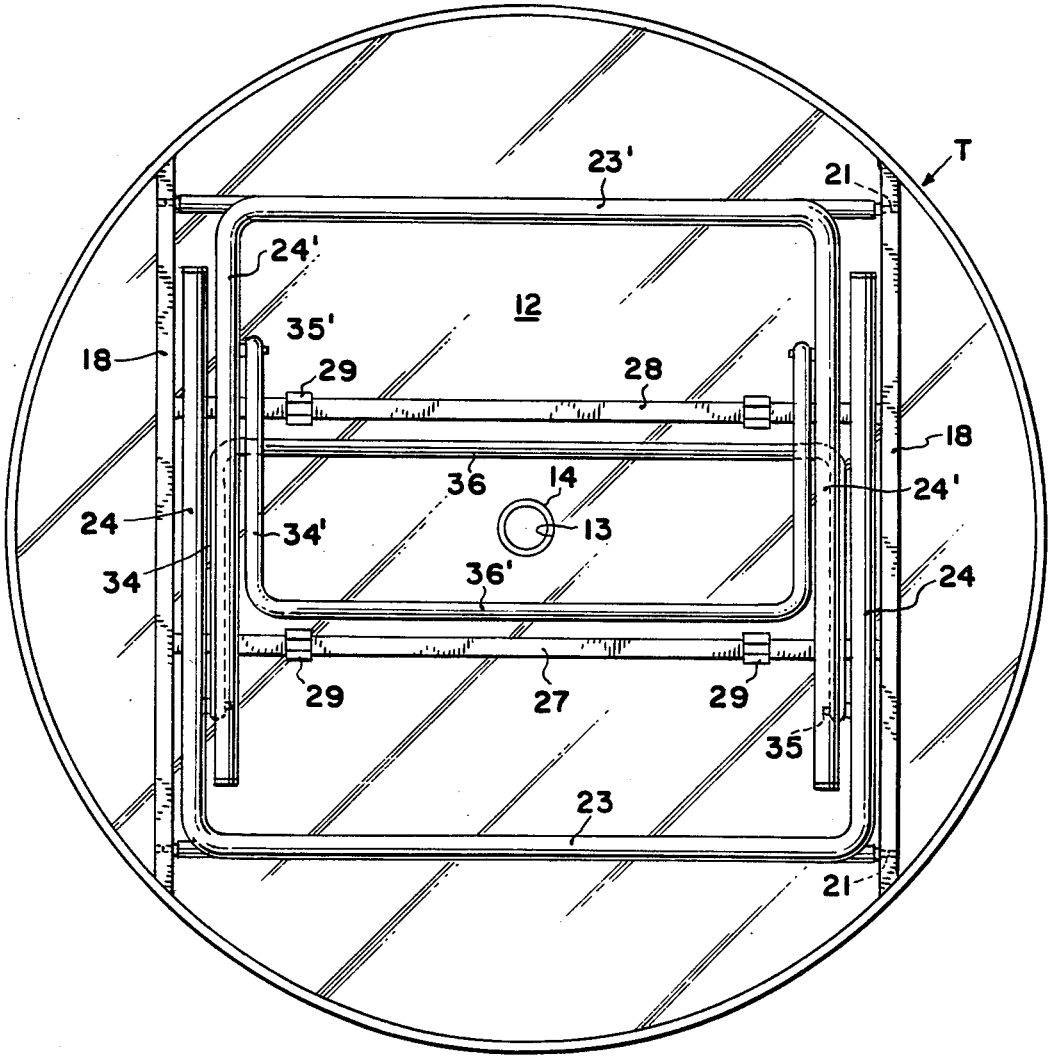
FIG. 5 is an under plan view with the leg assemblies in folded position, illustrating the manner in which the leg assemblies internest.

As FIGS. 1 and 5 perhaps best illustrate, side braces 18 span the rim 10 and their ends may be received within the lower channel 19 provided in the rim. Spanning these braces 18, near the ends thereof, are a pair of shafts 20 and 20' each having reduced diameter pins or portions 21 at their ends which are pivotally received by the braces 18.

Welded to the shaft 20, as at 22, along the length of shaft 20, is the upper rail 23 of the inversely U-shaped leg assembly 16, which has support legs 24. At the opposite end of the table, the upper cross rail 23' of the leg assembly 17, which has support legs 24', is similarly welded to the shaft 20' as at 22'. As FIG. 5 particularly indicates, the legs 24 are spaced apart a greater distance than the legs 24' and this permits the legs 24' to nest within the legs 24 when the legs are in the folded position, as indicated in FIG. 5.

Also spanning the braces 18 are a pair of rails 27 and 28 at a spaced distance inwardly of shafts 20. Rails 27 and 28 each mount pairs of longitudinally aligned keeper members 29, as FIGS. 1 and 4 particularly illustrate, the upper ends of the keeper members 29 being recessed as at 30, to receive the rails 27 to which they are joined. Each keeper member 29 is configured to provide a downwardly opening, partially closed socket defined by spreadable dependent legs 31 which extend a distance "x" below the center 32 of the socket. The keepers 29 are formed of a substantially rigid, yet resilient material, such as, for example, "delrin" plastic.

U-shaped braces, generally designated 33, for the leg assembly 16, and 33' for the leg assembly 17, include legs 34, pivotally secured to the legs 24 at 35, and (for the assembly 17) legs 34', pivotally secured to the legs 24' at 35'. It is to be observed that the legs 34 are spaced apart a greater distance than the legs 34' such that the brace 33' is inboard of the brace 33 in the folded position, as indicated in FIG. 5.

Figure 4:
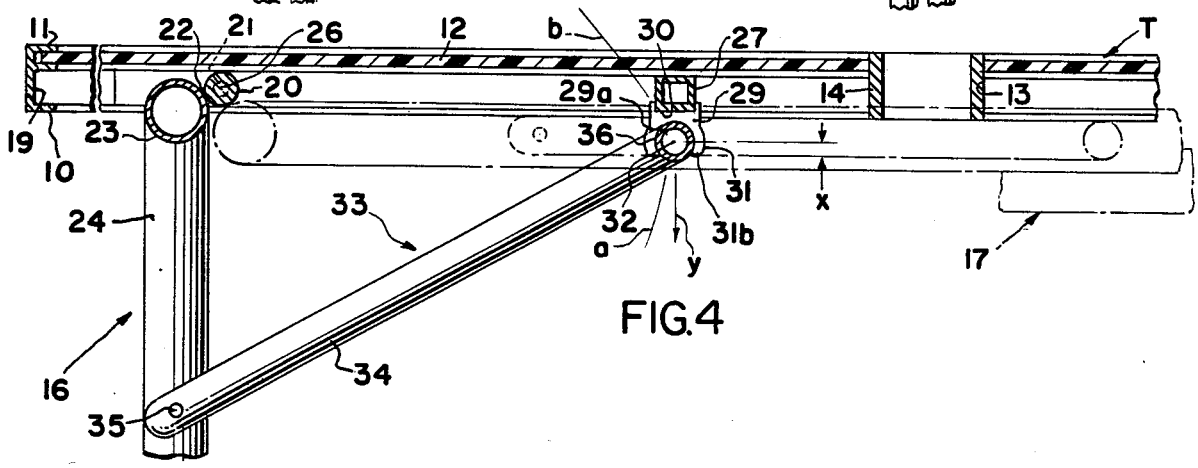
FIG. 4 is a fragmentary, sectional, side elevational view on an enlarged scale, with chain lines indicating folded positions of the leg assemblies.

As FIG. 4 indicates, the midportion web 36 of brace 33 and midportion web 36' of brace 33', can be removed from the socket openings **29*a* and 29*a'* respectively, and legs 31, only with a downward, substantially linear movement along line "y". This is accomplished if the table leg 24 is pivoted outwardly slightly about the axis 26 of shaft 21, for example, at the same time there is a downward pull on the brace 33 to pivot it about pivots 35. Normally, the member 36 is locked in position within socket 29*a* and there can be no pivoting of leg assembly 16 about the axis 26 or the axis of pins 35**.

The keepers 29 retain the brace midportion 36 or 36' in position because any tendency to rotate shafts 20 or 20' about axes 26, as along arc a, is resisted by the portions **31*a* of the keeper legs 31. The keeper leg portions 31*b* also resist any downward pivoting of brace portion 36 about leg pivots 35 or 35' on the arc b. Thus, once the portions 36 and 36' are engaged in the keeper sockets, they are effectively locked in position. It is when shafts 20 and 20' are pivoted at a time when legs 34 are also pivoted, that a compound motion is achieved which permits the brace portions 36 and 36' to move downwardly out of the sockets. When this occurs, the leg assemblies 16 and 17 can be folded to the nested positions disclosed in FIG. 5 and, because the leg members 23–24 internest with the leg portions 23'–24', and the brace portion 33 internests with the brace portion 33'**, either leg assembly can be folded up first of all.

In the manner disclosed, and assuming the table is functioning as a pool or patio table, it should be readily apparent that it is rigidly held in position when in use, but is readily foldable to the FIG. 5 position to facilitate its storage in the winter time.

While one embodiment of the invention has been described in detail, it will be apparent to those skilled in the art that the disclosed embodiment may be modified. Therefore, the foregoing description is to be considered exemplary, rather than limiting, and the true scope of the invention is that defined in the following claims.

What is claimed is:

1. In a folding table, suited to patio and poolside use as well as to interior use; a horizontally disposed table top having a transparent sheet top with a downwardly projecting rim; opposed foldable, nesting leg assemblies for said top, said leg assemblies being movable from a vertical position in which they support said top to a substantially horizontal position folded in nested relation against the bottom side of said top; a shaft for each leg assembly spanning said top rim and mounted for rotation with respect thereto; each leg assembly including a cross-rail generally coextensive with one of said shafts and fixed thereto, a pair of transversely spaced support legs projecting from opposite ends of each rail, and a U-shaped brace spanning said leg assembly, having a brace mid-portion with legs connecting the opposite ends thereof pivotally securing to said leg assembly at a spaced distance below said rail, a spreadable keeper member having a downwardly opening socket fixed to the underside of said top on each side of the center thereof in a location such as to releasably lockably receive the brace mid-portion and retain the leg assemblies in vertical position; the transverse length of one brace mid-portion and the spacing between the legs of one leg assembly being less than that of the other leg assembly so as to nest therein in the folded position; the legs of each brace securing to the leg assembly inwardly of the top supporting legs and each brace mid-portion being of such transverse length as to nest within the leg assembly when the brace mid-portions are removed from said sockets and folded against said table top; and the U-shaped brace on one leg assembly nesting within the U-shaped brace on the other leg assembly when the leg assemblies are in folded position.

2. The improvement invention of claim 1 wherein said upper rail of each leg assembly comprises a cylindrical tubular member welded to said shaft below and outwardly of said shaft axis such that the center of said tubular member substantially aligns with the centers of said sockets when the leg assembly is pivoted about said shaft axis to folded position.

3. The improvement invention of claim 2 wherein rails parallel to said shafts span the rim at a spaced distance inboard of said shafts, and a pair of said keepers are fixed to each of said rails and project downwardly therefrom; said pair of keepers being located such as to be outboard in each instance of the folded position of the brace which is lockably received by the other pair of keepers.

4. The improvement invention of claim 1 wherein said keeper legs are spread uniformly to release said brace mid-portions when the leg assemblies are rotated about said shafts at the same time the brace legs are pivoted to achieve an essentially vertical movement of the brace mid-portions out of said sockets.

5. In a folding table, suited to patio and poolside use as well as to interior use; a horizontally disposed table top having a sheet top with a downwardly projecting rim; opposed foldable, nesting leg assemblies for said top said leg assemblies being movable from a vertical position in which they support said top to a substantially horizontal position folded in against the bottom side of said top; a shaft pivot for each leg assembly received by said top rim and mounted for rotation with respect thereto; each leg assembly including an upper rail member connected with said shaft pivots and rotatable therewith, a pair of transversely spaced support legs projecting from opposite ends of each rail, and a U-shaped brace spanning said leg assembly, having a brace mid-portion with legs connecting the opposite ends thereof pivotally securing to said leg assembly at a spaced distance below said rail, a spreadable keeper member having a downwardly opening socket fixed to the underside of said top on each side of the center thereof in a location such as to releasably receive the brace mid-portion, the socket being defined by rigid resilient legs which extend below the center of a brace mid-portion received by the socket and extend inwardly under the brace mid-portion, and lockably retain the leg assemblies in vertical position; the keeper legs being uniformly spreadable to release the brace mid-portions when the leg assemblies are simultaneously rotated outwardly about said shaft pivots and the brace leg portions are pivoted downwardly.

* * * * *